US009109849B2

(12) United States Patent
Young et al.

(10) Patent No.: US 9,109,849 B2
(45) Date of Patent: Aug. 18, 2015

(54) FORWARD EJECTION ASSEMBLY FOR FIREARMS

(71) Applicants: Nicholas E. Young, Murray, UT (US); Andrew Gary Sunseri, Cottonwood Heights, UT (US)

(72) Inventors: Nicholas E. Young, Murray, UT (US); Andrew Gary Sunseri, Cottonwood Heights, UT (US)

( * ) Notice: Subject to any disclaimer, the term of this patent is extended or adjusted under 35 U.S.C. 154(b) by 0 days.

(21) Appl. No.: 14/211,568

(22) Filed: Mar. 14, 2014

(65) Prior Publication Data

US 2015/0040451 A1 Feb. 12, 2015

Related U.S. Application Data

(60) Provisional application No. 61/792,829, filed on Mar. 15, 2013.

(51) Int. Cl.
*F41A 15/16* (2006.01)

(52) U.S. Cl.
CPC ..... *F41A 15/16* (2013.01)

(58) Field of Classification Search
USPC ..... 42/25, 46, 68
See application file for complete search history.

(56) References Cited

U.S. PATENT DOCUMENTS

| | | | | | |
|---|---|---|---|---|---|
| 1,533,967 | A | * | 4/1925 | Browning | 89/148 |
| 1,564,014 | A | * | 12/1925 | Pedersen | 42/25 |
| 2,096,028 | A | * | 10/1937 | Burton et al. | 42/17 |
| 2,290,156 | A | * | 7/1942 | Brewer | 89/194 |
| 2,767,617 | A | * | 10/1956 | Taylor | 89/33.4 |
| 2,803,080 | A | * | 8/1957 | Simmons | 42/25 |
| 4,015,356 | A | * | 4/1977 | Maillard | 42/68 |
| 4,269,108 | A | * | 5/1981 | Stoner | 89/33.01 |
| 5,675,924 | A | * | 10/1997 | Predazzer | 42/25 |

* cited by examiner

*Primary Examiner* — Michael David

(57) ABSTRACT

Ejection assemblies, actions including such ejection assemblies, and firearms including such actions and/or ejection assemblies are provided herein. At least one ejection assembly is provided that is configured to facilitate forward ejection of spent cartridges when a forward-ejection guide cover is in place on a receiver, and to allow for side ejection of spent cartridges when the forward-ejection guide cover is out of place on the receiver. Such a configuration may allow for reliable ejection and access to the action for clearance of jams or malfunctions while providing flexibility with forward or conventional side ejection.

20 Claims, 7 Drawing Sheets

FORWARD EJECTION ASSEMBLY FOR FIREARMS

RELATED APPLICATIONS

This application claims the benefit of U.S. Provisional Patent Application Ser. No. 61/792,829 filed Mar. 15, 2013, and entitled "FORWARD EJECTION ASSEMBLY FOR FIREARMS," the disclosure of which is hereby incorporated by reference in its entirety.

BACKGROUND

Bullpup or other short-configuration rifles are designed to have a short, overall length compared to conventionally configured rifles, yet they maintain a relatively longer barrel. Such configurations place the action closer to the operator compared to conventionally configured rifles. Firing cartridges from semi-automatic firearms results in spent, hot casings being ejected from the action. In an effort to reduce the potential for the hot casings contacting the operator, some previous bullpup-configured rifles have made use of complicated, unreliable forward ejection systems, which have been difficult to operator and access.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Ejection assemblies, actions including such ejection assemblies, and firearms including such actions and/or ejection assemblies are provided herein. At least one ejection assembly is provided that is configured to facilitate forward ejection of spent cartridges when a forward-ejection guide cover is in place on a receiver, and to allow for side ejection of spent cartridges when the forward-ejection guide cover is out of place on the receiver. Such a configuration may allow for reliable ejection and access to the action for clearance of jams or malfunctions while providing flexibility with forward or conventional side ejection.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Ejection assemblies, actions including such ejection assemblies, and firearms including such actions and/or ejection assemblies are provided herein. At least one ejection assembly is provided that is configured to facilitate forward ejection of spent cartridges when a forward-ejection guide cover is in place on a receiver, and to allow for side ejection of spent cartridges when the forward-ejection guide cover is out of place on the receiver. Such a configuration may allow for reliable ejection and access to the action for clearance of jams or malfunctions while providing flexibility with forward or conventional side ejection.

Figure 1A:
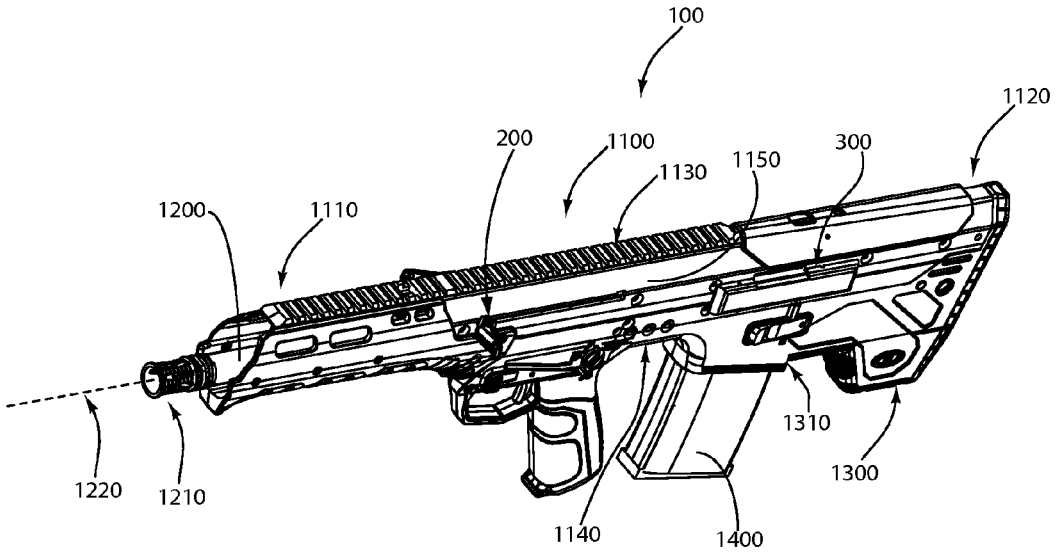
FIGS. 1A-1B illustrate perspective views of an exemplary firearm.
Figure 1B:
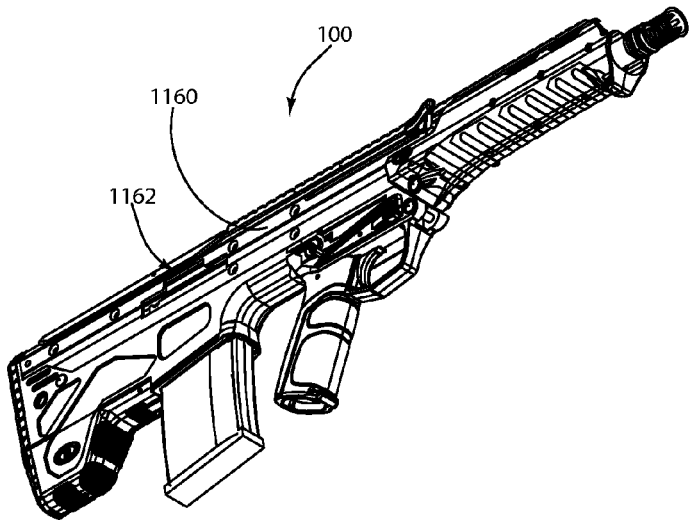

FIGS. 1A and 1B illustrate an exemplary firearm 100. As illustrated in FIG. 1A, the firearm 100 may be configured as a rifle, though it will be appreciated that the firearm 100 may have other configurations. The firearm 100 includes a receiver 1100 configured to couple or facilitate coupling of a barrel 1200 to an action 200. In at least one example, the firearm 100 further includes a stock assembly 1300 coupled to the receiver 1100. It will be appreciated that the stock assembly 1300 may be partially or completely integrated with the receiver 1200 in some examples.

The receiver 1100 is configured to facilitate operation of the action 200 to cycle a cartridge into a chamber defined in the barrel 1200 and bring a bolt head (2400, FIG. 2) into battery, allowing the action 200 to tire the cartridge causing rapidly expanding gasses to propel a projectile from a muzzle 1210 of the barrel. Components and parts of components will be described as being forward of other parts located more distally from the muzzle 1210. Relative position or movement toward the muzzle 1210 will be described as forward movement, and such position may be generally described as front or frontward. Similarly, components or parts of components which are more distal from the muzzle 1210 will be described as being rearward of other elements located more proximal to the muzzle 1210, and such position will be described as rear locations. The axial translations set forth herein will be understood to be generally parallel to an axis 1220 defined by a center of the barrel 1200. Lateral or transverse movement may be described with respect to any datum. In many instances described below, lateral movement is described with respect to a lateral sidewall of the receiver 1100, such as the first sidewall 1150 or the second sidewall 1160, an ejection panel, and/or an ejection carriage, which description may be interchangeable with movement described as being toward an ejection opening or toward a forward-ejection guide cover, which may be coupled to or associated with an ejection opening 1162 defined in the second sidewall 1160 of the receiver 1100.

The receiver 1100 may include a front portion 1110 configured to couple to and/or receive the barrel 1200. The receiver 1100 may also include a rear portion 1120, a top portion 1130, a bottom portion 1140, a first opposing sidewall portion 1150, and a second sidewall portion 1160. As illustrated in FIGS. 1A-1B, the bottom portion 1140 is configured to have a magazine 1400 coupled thereto. In at least one example, the magazine 1400 is further coupled to the firearm 100 via the stock assembly 1300 and via a magazine well 1310 formed in the stock assembly 1300 adjacent to the bottom portion 1140 of the receiver 1100.

Figure 1C:
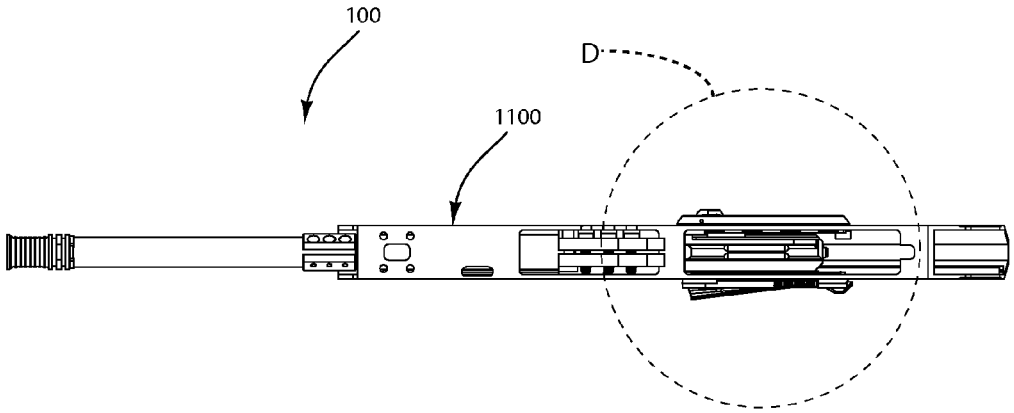
FIG. 1C illustrates a bottom view of the firearm of FIG. 1A in which the stock assembly of the firearm has been removed.
Figure 1D:
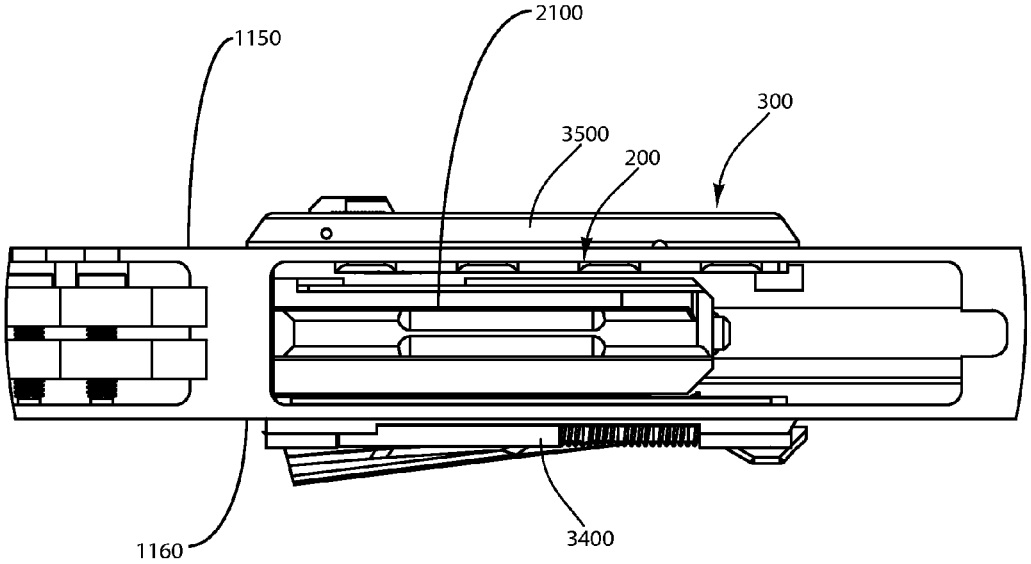
FIG. 1D illustrates a detail view of portion D of FIG. 1C.

FIG. 1C illustrates a bottom view of the firearm 100 in which the stock assembly 1300 (FIG. 1A) has been removed from the receiver 1100. FIG. 1D illustrates a detail of portion D of the firearm shown in FIG. 1C. As illustrated in FIG. 1D, rifle further includes an ejection assembly 300 configured to interact with the action 200. As illustrated in FIG. 1D, the action 200 generally includes a bolt carrier subassembly 2100. The bolt carrier subassembly 2100 is configured to move rearwardly in opposition to a biasing force applied thereto. For example, firing a cartridge may result in a rearward force action in the bolt carrier subassembly 2100. As the bolt carrier subassembly 2100 moves rearwardly, the action 200 engages the ejection assembly 300 to cause the ejection assembly 300 to at least partially eject a spent cartridge. In some examples, forward movement of the action 200 ejects a spent cartridge in a forward direction, thereby completing a forward ejection process while feeding a cartridge into the barrel 1200 (FIG. 1A) if the magazine 1400 (FIG. 1A) is coupled to the firearm 100 and if a cartridge is loaded into the magazine 1400 (FIG. 1A). The exemplary action 200 will be described in more detail hereinafter, followed by a more detailed description of the exemplary ejection assembly 300.

Figure 2A:
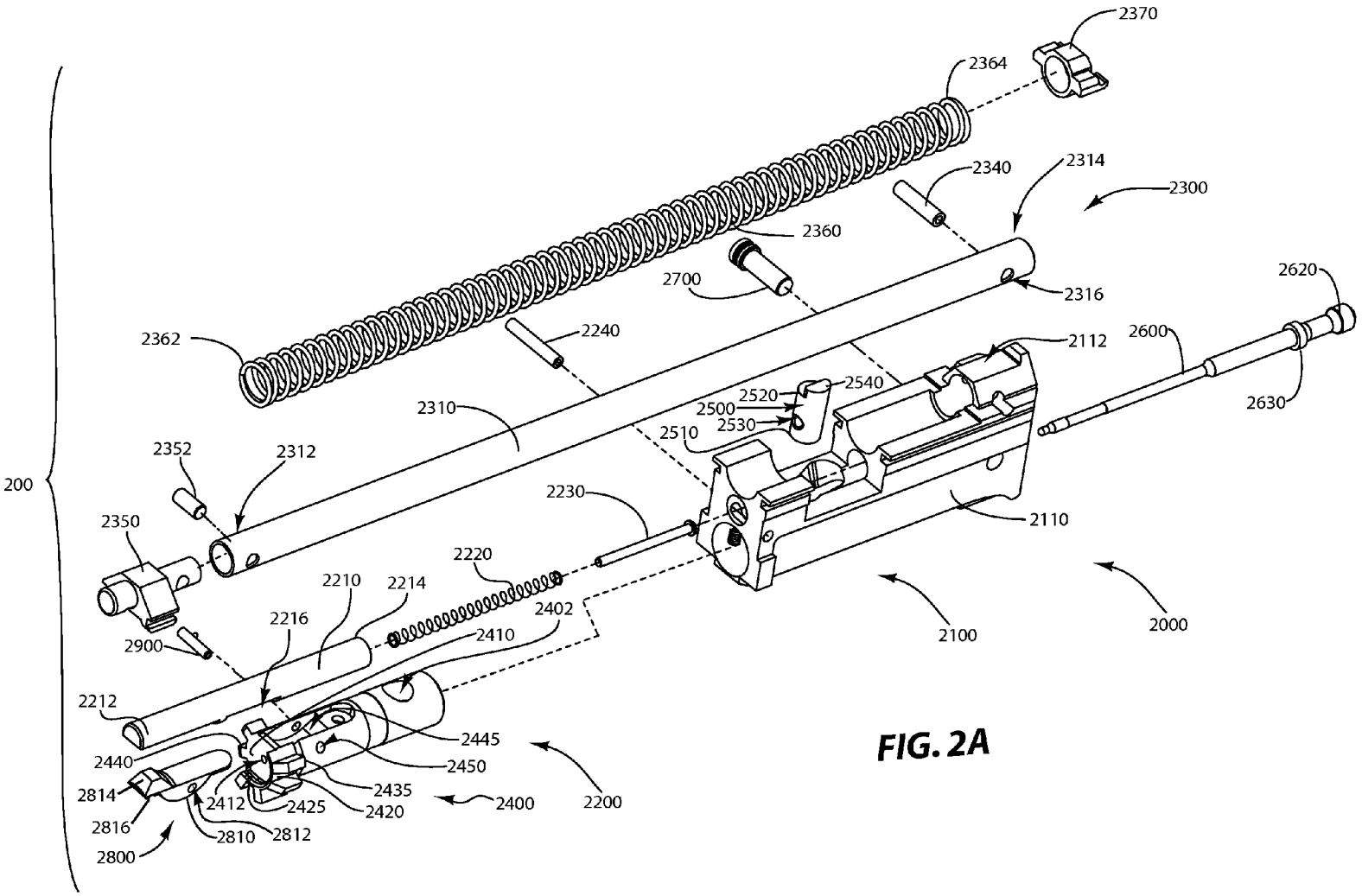
FIG. 2A illustrates an exploded view of at least a portion of an action.
Figure 2B:
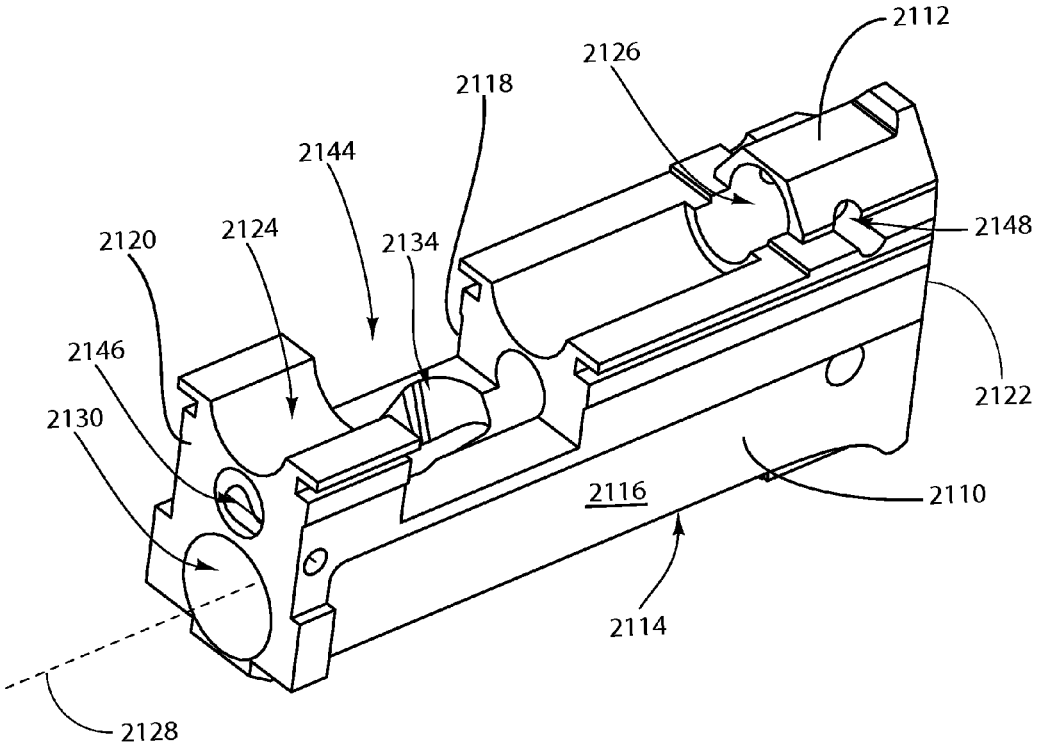
FIG. 2B illustrates the bolt carrier of the action of FIG. 2A.

FIG. 2A illustrates an exploded view of at least a portion of the action 200 while FIG. 2B illustrates a bolt carrier 2110 in more detail. As illustrated in FIGS. 2A-2B, the action 200 generally includes a bolt assembly 2000 that includes the bolt carrier subassembly 2100 introduced and a plunger subassembly 2200. The bolt assembly 2000 is configured to couple to a recoil subassembly 2300. Rearward movement of the action acts against the recoil subassembly 2300, rearward movement in response to firing a cartridge, or external force applied to the action (such as by way of a charging handle).

The bolt assembly 2000 may also include a bolt head 2400. The bolt carrier subassembly 2100 generally includes a bolt carrier 2110. The bolt carrier 2110 has various openings, recesses, slots, holes and other features defined therein to facilitate the assembly and operation of the action 200. For example, the bolt carrier 2110 may have a top 2112 a bottom 2114, a first side 2116, a second side 2118, as well as a front portion 2120 and a rear portion 2122. A recoil rod guide channel 2124 may be defined in the top portion 2112 of the bolt carrier 2110 that extends rearwardly from the front portion 2120 as shown. The recoil rod guide channel 2124 may be in communication with a recoil rod receiving recess 2126 defined in the bolt carrier 2110. In particular, the recoil rod receiving recess 2110 may be positioned at a location in the top portion 2112 of the bolt carrier 2110 that is rearward of the recoil rod guide channel 2124. In at least one example, the recoil rod guide channel 2124 and the recoil rod receiving recess 2126 may be generally parallel to a center axis 2128 of the bolt carrier, which center axis 2128 in turn may be generally parallel to a center axis 1210 of the barrel 1200 when the action 200 is coupled to the receiver 1100 (all shown in FIG. 1A) as described above.

In the exemplary bolt carrier 2110 shown in FIGS. 2A-2B, the bolt carrier 2110 further includes a bolt head receiving recess 2130 defined in the front portion 2120 thereof. The bolt head receiving recess 2130 may be described as being at a position that is more proximate to the magazine well 1310 (FIG. 1A) defined in the receiver 1100 (FIG. 1A) when the bolt assembly 2000 is coupled to the receiver 1100. Such a position may correspond to the lower part of the front portion 2120 of the bolt carrier, as shown in at least one of the figures. In particular, the bolt head receiving recess 2130 may extend from the front portion 2120 of the bolt carrier 2110 rearward. The bolt head receiving recess 2130 may be in communication with a firing pin receiving recess (not shown) that is defined in the lower part of the rear portion 2122 of the bolt carrier 2110.

In at least one example, a bolt pin guide slot 2134 (or pin guide slot) may be defined in the bolt carrier 2110 so as to be in communication with the bolt head receiving recess 2130. As will be discussed in more detail at an appropriate point hereinafter, the bolt pin guide slot 2134 is configured to cooperate with other components to facilitate rotation of the bolt head 2400 between a closed position and an open position. In the illustrated example, the bolt pin guide slot 2134 is generally transverse to the bolt head receiving recess 2130.

As shown in FIGS. 2A-2B, the bolt carrier 2110 also includes a plunger receiving recess 2146 defined therein. As will be discussed in more detail hereinafter, the plunger subassembly 2200 engages the bolt head 2400 during at least a feed stage of the action cycle to maintain the bolt head 2400 at a relatively forward position relative to the bolt carrier 2110. Maintaining the bolt head 2400 at a forward or extended position relative to the bolt carrier 2110 may correspond to an unlocked position for the bolt head 2400. The interaction between the plunger subassembly 2200 and the bolt head 2400 may allow the bolt head 2400 to rotate into a locked position once the bolt head 2400 is in position relative to barrel lugs (not shown) associated with the barrel 1200 (FIG. 1A). Accordingly, the mechanism for maintaining the bolt head 2400 forward and for releasing the bolt head 2400 ahead of rotation of the bolt head 2400 during a feed stage of the cycle translates with the bolt carrier 2110. In the illustrated example, the plunger receiving recess 2146 is defined in the bolt carrier 2110 between the recoil rod guide channel 2124 and the bolt head receiving recess 2130. Accordingly, the plunger receiving recess 2146 may extend from the forward or front portion 2120 of the bolt carrier 2110 and extend rearward.

The bolt head receiving recess 2130 may be generally parallel to the recoil rod guide channel 2124 and the recoil rod receiving recess 2126. In some of the illustrated examples, the plunger receiving recess 2146 is interrupted by the access slot 2144 introduced above, though it will be appreciated that the access slot 2144 may be shallower or omitted in some exemplary bolt carriers 2110 such that the plunger receiving recess 2146 may be uninterrupted in such examples. It will also be appreciated that in other exemplary bolt carriers 2110, the plunger receiving recess 2146 may be located in other positions on the bolt carrier 2110. In such examples, the plunger receiving recess 2146 is positioned to allow the plunger subassembly 2200 to urge the bolt carrier 2110 forward as will be described in more detail hereinafter.

As illustrated in at least one of the figures, various holes, recesses, or slots are defined in the bolt carrier 2110 that are generally transverse to the recoil rod guide channel 2124, the plunger receiving recess 2146, and/or the bolt head receiving recess 2130. Such holes, recesses, or slots may be configured to receive various retaining pins, rods, dowels, and the like to couple associated components to the bolt carrier.

The plunger assembly 2200 generally includes a plunger 2210, a plunger spring 2220, a plunger guide 2230, and a plunger retaining pin 2240. At least a portion of the plunger subassembly 2200, including at least rearward portions of the plunger guide 2230, the plunger spring 2220, and the plunger 2210 to be received within the plunger receiving recess 2146 defined in the bolt carrier 2110. In the illustrated example, the plunger 2210 may include a protrusion that is configured to cooperate with a plunger retaining pin 2240 to allow the plunger 2210 to translate relative to the bolt carrier 2110 in response to the biasing force exerted by the plunger spring 2220 against the plunger 2210 as introduced above while retaining the plunger 2210 relative to the bolt carrier 2110.

As illustrated in FIGS. 2A-2B, the plunger 2210 also includes a front portion 2212 and a rear portion 2214 in which a slot 2216 defined at some location therebetween. The slot 2216 may form a clearance slot and a tab channel. The tab channel may be generally parallel to a central axis 2128 of the bolt carrier 2110 when the bolt assembly 2000 is assembled. Further, the tab channel may be sized to receive and engage a tab portion 2540 of the bolt guide pin 2500.

In at least one example, the front end of the plunger 2210 extends beyond the bolt carrier 2110 but the plunger 2210 has its forward movement limited during cycling to an axial position that is rearward of a bolt face 2410 of the bolt head 2400.

For example, the recoil rod 2310 may have a front portion 2312 and a rear portion 2314. The rear portion 2314 may be at least be partially received in the recoil rod receiving recess 2126 defined in the bolt carrier 2110. The rear portion 2314 may have a transverse hole 2316 defined therein that may be aligned with one or more recoil rod retaining pin holes 2148 defined in the bolt carrier (2110). When thus aligned, a pin, such as a rear recoil rod pin 2340, may be at least partially received within one or more of the recoil rod retaining pin holes 2148 and the transverse hole 2316 in the rear portion 2314 of the recoil rod 2310 to thereby couple the recoil rod 2310 to the bolt carrier 2110.

The front portion 2312 of the recoil rod 2310 has a forward assist guide 2350 coupled thereto. In the illustrated example, the forward assist guide 2350 is coupled to front portion 2312 of the recoil rod 2310 via a pin, such as a front recoil rod pin 2352 as shown. A recoil spring 2360 is configured to be positioned over the recoil rod 2310, as will be described in more detail below.

As illustrated in the FIGS. 2A and 2B, a rear portion 2364 of the recoil spring 2360 may include or be coupled to a receiver coupler 2370 configured to couple to the receiver 1100 (FIG. 1A). In at least one example, the receiver coupler 2370 is configured to remain relatively more stationary with respect to the receiver 1100 (FIG. 1A) than other portions of the recoil spring 2360 and a front portion 2362 of the recoil spring 2360 in particular. Accordingly, the rear portion 2364 of the recoil spring 2360 may be secured relative to the receiver 1100 (FIG. 1A) when the recoil spring 2360 is positioned over the recoil rod 2310 and the receiver coupler 2370 is secured to the receiver 1100 (FIG. 1A). The front portion 2362 of the recoil spring 2360 is configured to but up against the forward assist guide 2350 to thereby position the recoil spring 2360 over the recoil rod 2310 between the receiver coupler 2370 and the forward assist guide 2350.

As introduced, the rear portion 2364 of the recoil spring 2360 remains relatively stationary. Accordingly, rearward movement of the forward assist guide 2350 compresses the recoil spring 2360 to thereby cause the recoil spring 2360 to exert a biasing force against the forward assist guide 2350. Rearward movement of the forward assist guide 2350 and/or the bolt carrier 2110 may be in response to recoil forces acting on a piston (not shown) that in turn acts against the forward assist guide 2350, recoil forces acting against the forward assist guide 2350 directly, recoil forces acting on the bolt carrier 2110, the bolt head 2400, or other components of the bolt assembly 2000 or action 200, manual forces acting on any of the foregoing, or any other forces or combination of forces.

The biasing force resulting from the rearward movement may result in potential energy being stored in the compressed recoil spring 2360. Once rearward movement of the forward assist guide 2350 and/or the bolt carrier 2110 is complete, the recoil spring 2360 may return toward its uncompressed position thereby exerting a force against the forward assist guide 2350, which in turn urges the bolt carrier 2110, and all those components that translate therewith, forward. Accordingly, the bolt assembly 2000 is configured to move rearwardly to compress the recoil spring 2360 and forward (in response to releasing energy stored in the compressed spring). Relative movement of the bolt assembly 2000 with respect to the receiver 1100 (FIG. 1A) cooperates with the ejection assembly 300 (FIG. 3) to cycle the action 200 to extract cartridges from the chamber and feed cartridges, such as from a magazine 1400 (FIG. 1A) coupled to the receiver 1100, into the chamber in the barrel 1200 (FIG. 1A). Cycling of the action 200 will be described in more detail after the assembly of the remainder of the bolt assembly and the ejection assembly are more fully introduced.

The bolt head 2400 is configured to be received at least partially within the bolt head receiving recess 2130 defined in the bolt carrier 2110. For example, a portion of the bolt head 2400 may be translatingly received within the bolt head receiving recess 2130, which coupling may cause the bolt head 2400 to both translate axially and rotate relative to the bolt carrier 2110.

The bolt head 2400 is further configured to have a bolt guide pin 2500 coupled thereto. In particular, the bolt guide pin 2500 may include a first or lower end 2510 and a second or upper end 2520. In such an example, the second or lower portion 2510 of the bolt guide pin 2500 is coupled to the bolt head. More specifically, the bolt head 2400 may have a bolt guide pin receiving recess 2402 or slot defined therein. The bolt guide pin receiving recess 2402 may be generally transverse to a central axis (not shown) of the bolt head 2400, which may be generally parallel to an axis defined by the center of the bolt carrier 2110, as previously introduced.

In at least one example, the bolt guide pin 2500 is configured to be coupled to the bolt head in such a manner than when the bolt head 2400 is coupled to the receiver 1200 (FIG. 1A), the bolt guide pin 2500 is positioned to extend at least partially into the bolt pin guide slot 2134 defined in the bolt carrier 2110. In such a position, the bolt guide pin 2500 contacts the bolt carrier 2110 adjacent the bolt guide pin slot 2134, which may include opposing lateral edge surfaces and/or opposing end surfaces. Such contact may constrain the movement of the bolt head 2400 relative to the bolt carrier 2110, such as to retain the bolt head 2400 relative to the bolt carrier 2110 while allowing axial translation of the bolt carrier 2110 relative to the bolt head 2400 to result in rotation of bolt head 2400, as will be discussed in more detail hereinafter.

In at least one example, the firing pin 2600 extends through the bolt guide pin 2500 via a coupling hole 2530 defined in the bolt guide pin 2500 and into the bolt head 2400. A rear portion 2620 of the firing pin 2600 is received within a corresponding slot (not shown) defined in the rear portion of the bolt carrier 2110 that is in communication with the bolt head receiving recess 2130 described elsewhere herein.

A firing pin retainer 2700 retains the firing pin within bolt carrier 2110 while allowing the firing pin 2600 a desired amount of axial translation. In particular, the firing pin 2600 may include a retainer feature 2630, such as a protrusion that is forward of the firing pin retainer 2700 when the firing pin 2600 is coupled to the bolt carrier 2110, that is configured to retain the firing pin 2600 within the bolt carrier 2110 while allowing constrained translation of the firing pin 2600 with respect to the bolt carrier 2110. Accordingly, the firing pin 2600 may move forward in response to a hammer striking the rearmost portion of the firing pin 2600. If the bolt head 2400 is held forward relative to the front portion 2120 of the bolt carrier 2110, in the unlikely event that such a striker were able to hit the firing pin 2600, the axial translation of the firing pin 2600 would be limited so as to prevent the firing pin 2600 from extending through the bolt head 2400, thereby preventing accidental discharge.

As will be discussed in more detail hereinafter, the plunger subassembly 2200 is configured to exert a biasing force on the bolt head 2400 during various stages of the firing cycle to maintain the bolt head 2400 forward relative to the bolt carrier 2110. The plunger subassembly 2200 is at a maximum compressed position when the bolt carrier 2110 is at a forward position. In this position, the front portion 2212 of the plunger 2210 may abut against any desired surface, such as the rear portion of a bolt extension and/or the breech of the barrel 1200 (FIG. 1A), which may be described as an abutment surface or datum surface. As the bolt carrier 2110 moves rearward, the plunger spring 2220 expands causing the front end 2212 of the plunger 2210 to remain in contact with the datum surface and therefore allowing the front end 2212 of the plunger 2210 to move away from the front portion 2120 of the bolt carrier 2110.

During initial rearward of the movement of the bolt carrier 2110, the bolt head 2400 remains relatively stationary with respect to axial translation while rotating out of engagement with the barrel 1200 and lugs (not shown) formed in the barrel 1200 (FIG. 1A). In particular, the bolt guide pin 2500 moves from a first position in which it engages a rearward portion of the bolt pin guide slot 2134 defined in the bolt carrier 2110 to a second, rotated position as the bolt guide pin moves toward and into engagement with the forward or front end of the bolt pin guide slot 2134. In the second, rotated position the bolt head 2400 is unlocked relative to the barrel 1200 (FIG. 1A) thus allowing the bolt head 2400 to be withdrawn from the barrel 1200 (FIG. 1A) and to extract a spent casing (or cartridge as the situation may be) from the chamber of the barrel 1200 (FIG. 1A). As the bolt guide pin 2500 rotates toward the second position, the tab 2540 associated with the second end 2520 of the bolt guide pin 2500 moves into the slot 2216 in the plunger 2210, first into the clearance portion of the slot 2216, then into the tab channel portion of the slot 2216.

As the bolt carrier 2110 continues to move rearward, the bolt guide pin 2500, and the tab 2540 of the bolt guide pin 2500 in particular, engages the plunger 2210 by contacting the plunger 2210 adjacent the rear end of the slot 2216 that forms a tab channel. The biasing force exerted against the plunger 2210 as the plunger 2210 thus extends causes the plunger 2210 to act against the bolt guide pin 2500 to urge the bolt guide pin 2500 toward the front end of the bolt pin guide slot 2134. As previously discussed, when the bolt guide pin 2500 is in contact with the front end of the slot 2216, the bolt head 2400 is in an unlocked position. Accordingly, the coupling of the plunger 2210 to the bolt head 2400 via the interaction between the slot 2216 on the plunger 2210 and the tab 2540 of the bolt guide pin 2500 may help maintain the bolt head 2400 in the second, unlocked position after the bolt head 2400 has been disengaged from the barrel and until the bolt head 2400 is again in position with the barrel 1200 (FIG. 1A), as will be discussed in more detail at an appropriate point hereinafter.

As introduced, the bolt assembly 2000 moves through various positions or states as the bolt carrier 2110 moves rearward relative to the barrel 1200 (FIG. 1A). Those positions or states include the bolt head 2400 being in a locked state in which the bolt guide pin 2500 contacts the rear portion of the bolt pin guide slot 2134 and in which the plunger 2210 is disengaged from the bolt head 2400, an unlocked state in which the bolt guide pin 2500 contacts the front portion of the bolt pin guide slot 2134 and in which the plunger 2210 is disengaged from the bolt head 2400, an unlocked state in which the bolt guide pin 2500 remains in contact with the front portion of the bolt guide pin slot 2134 in the bolt carrier 2110 and the plunger 2210 engages the bolt head 2400 via contact between the plunger 2210 and the bolt guide pin 2500, such as between the rear end of the slot 2216 and the tab portion 2540 the bolt guide pin 2500. As the bolt carrier 2110 continues to move rearward relative to the receiver 1100 (FIG. 1A), one or more components of the bolt assembly 2000 engage the ejection assembly 300 (FIG. 1B) to eject a spent casing (or cartridge if applicable) from the action 200 (FIG. 1B).

The plunger 2210 continues to engage the bolt head 2400 (thereby maintaining the bolt head 2400 forward) until the bolt head 2400 contacts the abutment surface or datum surface to thereby compress the plunger 2210. At or immediately after the plunger 2210 disengages from the bolt head 2400 to maintain the bolt head 2400 forward, the bolt head 2400 is in the appropriate axial position relative to the barrel 1200 (FIG. 1A). As the bolt carrier 2110 continues to move forward, the bolt guide pin 2500 moves from engagement with the front portion of the bolt guide pin slot 2134 to the rear portion thereof to rotate the bolt head 2400 into engagement with the barrel 1200 (FIG. 1A). As the bolt head 2400 rotates into locked engagement with the barrel 1200 (FIG. 1A), a bolt face 2410 portion of the bolt head 2400 draws into sufficient proximity that the firing pin 2600 is able to extend through a firing pin opening 2412 defined in the bolt face 2410. In such a position, the action 200 is in battery.

In at least one example, an assembly is provided with a plurality of bolt heads to allow the receiver 1100 (FIG. 1A) to fire multiple calibers of cartridges. In particular, the firing pin 2600 may be removed by removing the firing pin retainer 2700 and removing the firing pin 2600 from the rear of the bolt carrier 2110. Once the firing pin 2600 has been removed, the bolt guide pin 2500 is decoupled from the bolt head 2400. In some examples, the plunger subassembly 2200 may also be removed by removing the plunger retaining pin 2240 and then removing the associated components. Removing the plunger subassembly 2200 may ensure the plunger is decoupled from the bolt head 2400. The bolt head 2400 may then be removed and replaced with another bolt head of another caliber and the bolt assembly with the additional bolt head and other components described elsewhere herein. The barrel 1200 (FIG. 1A) and any barrel extension may then be removed and replaced with a barrel and barrel extension of a different caliber to thereby allow the receiver 1100 (FIG. 1A) to fire cartridges of different calibers.

Accordingly, the bolt guide pin 2500 is retainingly coupled to the bolt head 2400 by a firing pin 2600, which in turn is removably coupled to the bolt carrier 2110. Removing the firing pin 2600 and/or the plunger subassembly 2200 then allows the bolt head 2400 to be removed from the bolt carrier 2110. As such, the bolt head 2400 is removably coupled to the bolt carrier 2110.

Rotation of the bolt head 2400 closes and opens the bolt head 2400 relative to the barrel 1200 (FIG. 1A) and/or barrel extension associated therewith. According to several of the illustrated examples, the bolt face 2410 may be generally planar. A bolt face lip extends a first distance away from the bolt face 2410 that includes an outer perimeter portion 2420 that extends in an axial direction away from the bolt face 2410 and have a cartridge gripping portion 2425 that extends transversely away from the outer perimeter portion 2420. Such a configuration may allow the bolt head 2400 to engage the rim of a cartridge casing. The forward most portion of the outer perimeter portion 2420 may define a forward bolt face lip plane (not shown). A plurality of lugs 2435 may extend away from the outer perimeter portion 2420 in the opposite direction of the cartridge gripping portion 2425. As illustrated in FIG. 2A, the bolt head 2400 further includes clearance lugs 2440 about some remaining portion of the perimeter of the bolt face 2410 not associated with the bolt face flip. In particular, the clearance lugs 2440 extend from the bolt face 2410 in the opposite direction of the bolt face 2410.

In such a configuration, the clearance lugs 2440 may provide clearance in the bolt face lip outer perimeter portion to allow a cartridge to be pushed from the bolt face 2410. In at least one example, the clearance lugs 2440 are positioned on the side of the bolt head 2400 that is positioned opposite the location of the ejection assembly 300 (FIG. 1A) or a position that is adjacent an ejection port or a forward ejection guide cover. The clearance lugs 2440 may correspond to between about 80 to 150 degrees of the bolt face 2410, such as approximately 80 to 100 degrees, such as between 85 to 95 degrees such as about 90 degrees.

In the illustrated example, an extractor claw 2800 is configured to engage a portion of the bolt face 2410 and to engage a portion of a cartridge casing engaged by the bolt head 2400. In the illustrated example, the extractor claw 2800 includes a cammed surface 2810 having an engagement slot 2812 defined therein. The bolt head 2400 includes an extractor claw channel 2445 defined therein configured to allow the extractor claw 2800 to be received at least partially therein. An extractor pin slot 2450 is defined in the bolt head 2400 and positioned to align with the engagement slot 2812 in the extractor claw 2800. When thus aligned, an extractor pin 2900 may then couple the extractor claw 2800 to the bolt head 2400.

In at least one example, a biasing member (not shown), such as a spring, may be placed in the extractor claw channel 2445 between the bolt head 2400 and the extractor claw 2800 to exert a biasing force against the extractor claw 2800. In such an example, the extractor claw 2800 may pivot about the extractor pin 2900 such that the biasing force urges a front portion of the extractor claw 2800 toward a center of the bolt face 2410. In at least one example, the front portion of the extractor claw 2800 may include a lug 2814 that extends outwardly and a lip 2816 that extends inwardly. The extractor claw 2800 may be positioned opposite the side of the bolt head 2400 to which cartridges are fed into the action.

The extractor claw 2800 may be urged opened when moving forward into engagement during a feed process and then apply a biasing force to the cartridge, as is known in the art. This biasing force may act on the casing to maintain the cartridge in place relative to the bolt head 2400 during an extraction process, which includes rotating the bolt head 2400 from a lock position relative to the barrel extension and/or barrel. In particular, the extractor claw 2800 maintains a cartridge in place on the bolt face 2410 until the ejection assembly 300 (FIG. 1B) exerts a force on a spent casing or cartridge to clear the extractor claw 2800 from engagement with the bolt face. Accordingly, in one example an ejection assembly includes the ejector claw 2800 connected to the bolt head 2400 and configured to translate therewith and an extractor such as the ejection assembly set forth herein and its associated components, that moves into selective engagement with a spent casing or cartridge engaged by the bolt head 2400, and the bolt face 2410 in particular, and in which the ejection assembly is not directly connected to or carried with the bolt head. Particularly, the ejection assembly may be from lateral force than an axial force at an offset position. For example, a traditional ejector pin which is in place on a bolt face may be omitted in favor of a lateral ejection assembly. Accordingly, the ejection assembly may be described as a lateral and/or non-translating ejection assembly.

Referring again to FIG. 1D), a first sidewall 1150 of the receiver 1100 has some portion of the ejection assembly 300 coupled thereto, such as the ejection panel 3500. The ejection assembly 300 may also include a forward ejection guide cover 3400 coupled to the second sidewall 1160 via the ejection opening 1162 FIG. 1B) defined therein opposite the ejection panel 3400 and components associated with the ejection panel 3400.

Figure 3:
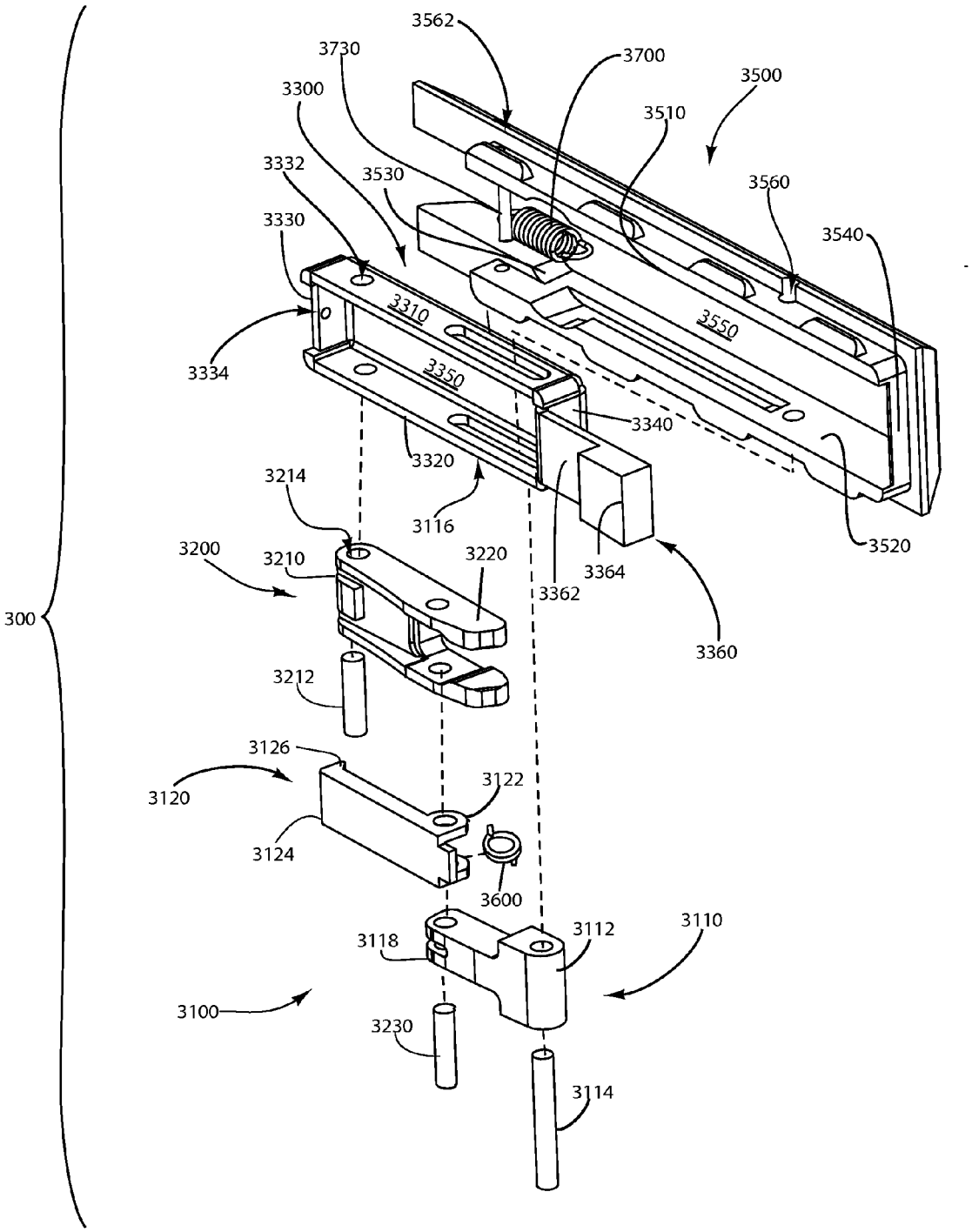
FIG. 3 illustrates an exploded view of at least a portion of an ejection assembly.

FIG. 3 illustrates an exploded view of the ejection assembly 300. As illustrated in FIG. 3, the ejection assembly 300 includes a plurality of links including a stationary link 3100 and a translating link 3200 (also referred to as an extraction link). The ejection carriage 3300 is configured to translate parallel to a plane defined by the first sidewall 1150 of the receiver 1100 (FIG. 1A), the ejection carriage 3300 is further configured to engage a bolt carrier 2110 (FIG. 2) during a retraction/extraction stage such that at least one of the stationary link 3100 and the translating link 3200 push a cartridge from the bolt face 2410 (FIG. 2B) of the bolt carrier 2110 (FIGS. 2A-2B) toward an ejection opening 1162 defined in the second sidewall 1150 of the receiver 1100 (FIG. 1B), wherein the spent casing or cartridge is ejected laterally or rearwardly when a forward ejection guide cover 3400 is out of position relative to the ejection opening 1162 (FIG. 1B) and wherein a portion of the bolt face 2410 (FIG. 2A) pushes the spent casing or cartridge forward through the forward ejection guide cover 3400 when the forward ejection guide cover 3400 is in position relative to the ejection opening 1162 (FIG. 1B). In some examples, the extractor claw 2800 (FIG. 2A) maintains the spent cartridge or casing in place on the bolt head 2400 (FIG. 2A) until the ejection assembly 300 (which is positioned on the first sidewall 1150 of the receiver 1100 and does not translate with the bolt head 2400) engages the spent casing or cartridge.

In at least one example, the ejection carriage 3300 and at least one of the stationary link 3100 and the translating link 3200 are coupled to an ejection panel 3500. In at least one example, the ejection panel 3500 includes opposing sidewalls (which may include a top wall 3510 and a bottom wall 3520), opposing end walls including a front wall 3530 and a rear wall 3540, and a base 3550, which are collectively sized and configured to receive at least a portion of the ejection carriage 3300 therein.

As will be discussed in more detail hereinafter, the ejection panel 3500 includes a plurality of opening or pin holes defined therein to accommodate coupling of the ejection carriage 3300 thereto. These holes may include a stationary link pin slot 3560 and a returning spring slot 3562 defined in the ejection panel 3500. In at least one example, the return spring slot 3562 is forward of the stationary link pin slot 3560, which may be positioned toward the rear wall 3540 of the ejection panel 3500. As discussed elsewhere, though illustrated as a component separate from the receiver, the ejection panel may be integrally formed with the receiver 1100 (FIGS. 1A-1B).

The ejection panel 3500 allows the ejection carriage 3300 to translate axially relative to the ejection panel 3500 to cause the linkages to move outwardly to eject or extract a spent casing or a cartridge from the action 200 (FIG. 1B). In the illustrated example, the ejection carriage 3300 generally includes a top portion 3310, a bottom portion 3320, a front wall 3330, a rear wall 3340, and a base 3350. The ejection carriage 3300 may include, have integrally formed therewith, or be coupled to, a bolt engaging member 3360. In the illustrated example, the bolt engaging member 3360 has an offset portion 3362 that is generally parallel to the base 3350 of the ejection carriage 3300 and a bolt carrier engagement portion 3364 that extends away from the offset portion 3362 toward the bolt carrier 2110 (FIG. 2A) when the action 200 (FIG. 2A) is assembled.

Referring again to FIGS. 2A-2B, the bolt carrier 2110 includes carriage engagement protrusion 2150 near a front portion 2120 of the bolt carrier 2110 that is configured to engage the bolt engaging member 3360 (FIG. 3) during a desired stage of rearward movement of the bolt carrier 2110 to thereby draw the ejection carriage 3300 rearward as well. Alternatively or in addition, a channel may be defined in the side of the bolt carrier 2110 which may receive a portion of the bolt engagement member 3360 (FIG. 3) of the ejection carriage 3300 (FIG. 3) and/or allow the bolt carrier 2110 to translate relatively freely with respect to the ejection carriage 3300 (FIG. 3) until the carriage engagement protrusion 2150 (and/or the end of such a channel) contacts the bolt carrier engagement portion 3464 of the ejection carriage 3400 (FIG. 3) to thereby draw the ejection carriage 3300 (FIG. 3) rearward as well.

Referring again to FIG. 3 and as will be discussed in more detail hereinafter, as the ejection carriage 3300 moves rearward, the stationary link 3100 and the translating link 3200 move outwardly from the first sidewall 1150 (FIG. 1A) of the receiver 1100 (FIG. 1A) in response to the rearward movement. Similarly, the links (3100, 3200) retract toward the ejection panel 3500 and/or the adjacent lateral sidewall 1150 (FIG. 1A) of the receiver 1100 (FIG. 1A) in response to forward movement of the ejection carriage 3300, as will be described in more detail below.

In at least one example, the stationary link 3100 (which may include a retaining link 3110 and/or the combination of the retaining link 3110 and a counter link 3120). The translating link 3200 (sometimes also referred to as an extraction link) may include a first end 3210 pivotingly coupled to the ejection carriage 3300, such as by way of a pin 3212 that engages holes 3214 defined in the first end 3210 of the translating link 3200 and corresponding sliding pin slots 3332 defined in the ejection carriage 3300 near a front or forward portion 3330 of the ejection carriage 3300. The first end 3210 of the translating link 3200 is pivotingly coupled to the ejection carriage 3300 such that the translating link 3200 translates with the ejection carriage 3300. The translating link 3200 may also include a second end 3220 that is urged outwardly when the ejection carriage 3300 moves rearwardly, such as through engagement between the ejection carriage 3300 and the bolt carrier 2110 and/or bolt head 2400 as the bolt head 2400 and/or bolt carrier 2110 (seen in FIGS. 2A-2B) move rearwardly, as will be discussed in more detail below.

The translating link 3200 is configured to pivotingly couple to the retaining link 3110 and/or the counter link 3120. In the illustrated examples, a first end 3112 of the retaining link 3110 is pivotingly coupled to the ejection panel 3500 and/or the receiver 1100 (FIG. 1B) in such a manner (such as via a stationary pin 3114) that the retaining link 3110 does not translate with the ejection carriage 3300. In particular, opposing stationary link access slots 3116 may be defined in the ejection carriage 3300 that allow the stationary pin 3114 to pass through the ejection carriage 3300 and through the first end 3112 of the retaining link 31110 while the first end 3112 of the retaining link 3110 is positioned proximate to or partially within a rear portion 3340 of the ejection carriage 3300.

A second end 3118 of the retaining link 3110 may pivotingly couple to a first end 3122 of the counter link 3120 and the translating link 3200 at a location between the first end 3210 and the second end 3220, such as by way of a cross link pin 3230. When thus assembled, rearward movement of the ejection carriage 3300 causes corresponding initial rearward movement of the translating 3200 link. As previously noted, the retaining link 3110 does not translate with the ejection carriage 3300. As a result, rearward movement of the stationary link 3100 exerts an axial force against the retaining link 3110. This axial force acting on the retaining link 3110 causes the retaining link 3110 to pivot about the stationary pin 3114. In at least one example, this pivoting causes the second end 3118 of the retaining link 3110 to rotate away from the first end 3112 of the retaining link 3110, and thus to move the second end of the retaining link 3110 away from the ejection panel 3500 and/or the receiver 1100 (FIG. 1A). As the second end 3118 of the retaining link 3110 moves away from the ejection panel 3500, the retaining link 3110 also moves the second end 3118 of the translating link 3200 away from the ejection panel 3500 and/or the receiver 1100 (FIG. 1A) due to the coupling between the translating link 3200 and the retaining link 3110 introduced above.

As also introduced above, a first end 3122 of the counter link 3120 is pivotingly coupled to the second end 3118 of the retaining link 3110. As a result, the retaining link 3110 moves away from the ejection panel 3500 and/or the receiver 1100 (FIG. 1A) as the second end 3118 of the retaining link 3110 pivots away from the ejection panel 3500 and/or the receiver 1100 (FIG. 1A). As a result, a second end 3124 of the counter link 3120 may move away from the ejection panel 3500 as the second end 3118 of the retaining link 3110 moves away from the ejection panel 3500. Further, the counter link 3120 may be generally collinear with the retaining link 3110 during an initial outward rotation of the retaining link 3110 but then may pivot slightly such that the second end 3124 of the counter link 3120 moves slightly toward the ejection panel 3500 and/or the receiver 1100 (FIG. 1B). Such movement may be in response to contact with a spent casing or a cartridge, which may allow the counter link 3120 to maintain contact with spent casing or cartridge. In at least one example, a biasing member, such as a torsional spring 3600, may be coupled to the retaining link 3110 and/or the counter link 3120 to urge the counter link 3120 toward linear alignment with the retaining link 3110 while allowing the counter link 3120 to pivot such that the second end 3124 of the counter link 3120 deflects toward the ejection carriage 3300, the ejection panel 3500, and/or the receiver 1100 (FIG. 1A) when a force acts against the second end 3124 of the counter link 3120. In some examples, the torsion spring 3600 may allow for a rotational range of about 50 degrees for the counter link 3120 relative to the retaining link 3110.

In some examples, the retaining link 3110 and the counter link 3120 may be formed as a single stationary link 3100. In some examples, the counter link 3120 may be a flexible link. In some examples, the second end 3124 of the counter link may have an angled portion 3126 that is hooked or angled away from the bolt carrier 2110 toward the receiver 1100 (FIG. 1B), the ejection panel 3500 or other adjacent components, particularly when the links associated with the ejection panel 3500 are retracted.

Figure 4:
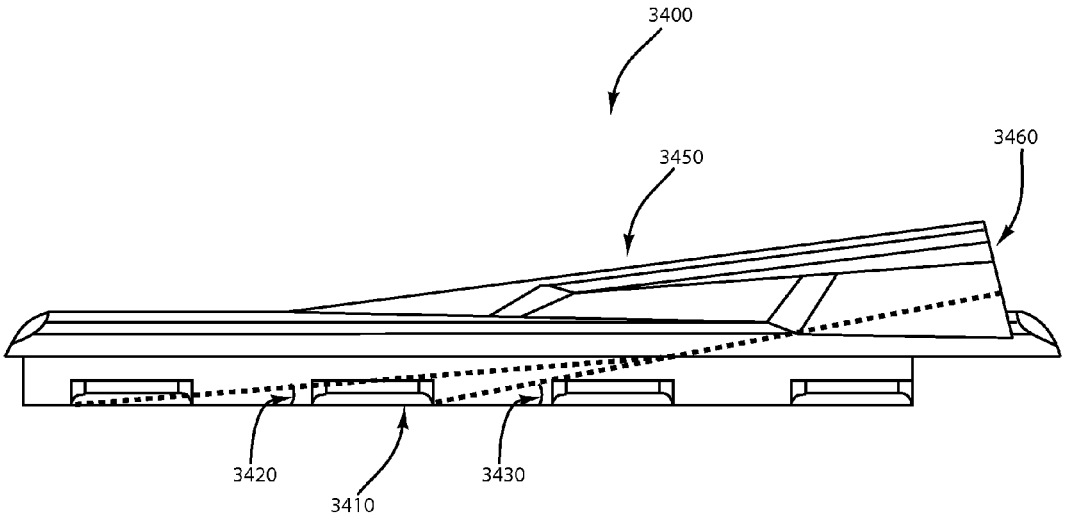
FIG. 4 illustrates a forward ejection guide cover according to one example.

FIG. 4 illustrates the forward ejection guide cover 3400 in more detail. In the illustrated example, the forward ejection guide cover 3400 is configured to guide the spent casing or cartridge from the receiver 1100 (FIG. A) at an angle of between about 4 and about 12 degrees relative to the second sidewall 1160 (FIG. B), such as a forward ejection angle of between about 5 and about 8 degrees. In at least one example, the forward ejection guide cover 3400 includes a base 3410 defining a plane and a multi-stage ejection port having a first ejection angle 3420 as measured from the plane 3410 and a second ejection angle 3430 measured from the plane defined by the base 3410, the second ejection angle 3430 being greater than the first ejection angle 3420. In at least one example, the first ejection angle 3420 is configured to receive a spent casing first during a forward ejection process. In some examples, the first ejection angle 3420 may be between about 3 and 5 degrees and the second ejection angle 3430 may be between about 8-12 degrees.

In at least one example, a multi-stage ejection port may have a first diameter adjacent the base 3410, an intermediate diameter in an intermediate portion 3450, and a third diameter at an exit 3460 of the ejection port. The first diameter may be greater than the second diameter and the third diameter may also be greater than the second diameter. In some examples, the diameters described may correspond to the ejection angles described above in which the first ejection angle 3420 to the second ejection angle 3430 corresponds to the entry to the intermediate area 3450 and the intermediate area 3450 to the exit 3460 corresponds to the second ejection angle 3430.

Figure 5A:
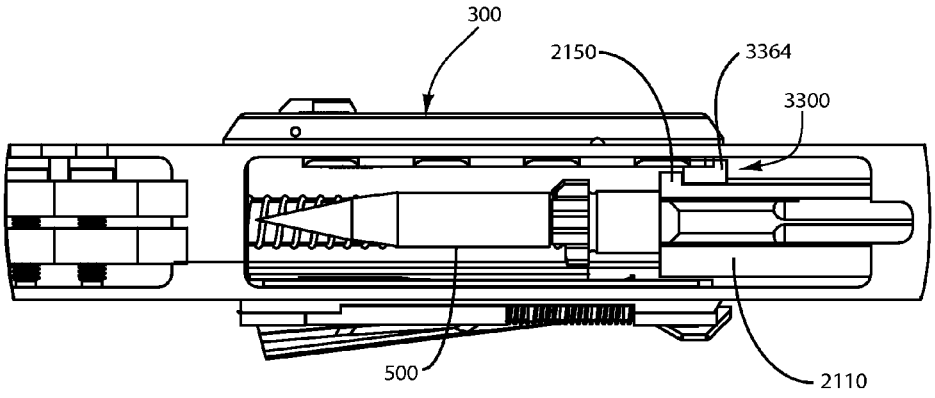
FIGS. 5A-5D illustrate a detail view of the cycle of firing a cartridge from a firearm.

FIGS. 5A-5D illustrate the extraction of a cartridge 500. A live cartridge 500 is shown, though it will be appreciated that typically spent casings are extracted during the extraction phase of firing a firearm 100. FIGS. 5A-5D is a bottom, detail view of the firearm 100 in which the stock assembly 1300 (FIG. 1A) has been removed to show detail D of FIG. 1C. As illustrated in FIG. 5A, the bolt carrier 2110 is in a relatively rearward position. As previously discussed, the bolt carrier 2110 may move rearwardly in a response to a number of forces. As the bolt carrier 2110 moves rearwardly, the bolt carrier 2110, and the carriage engagement protrusion 2150 in particular, engages the ejection assembly 300 and the bolt carrier engagement portion 3364 of the ejection carriage 3300 in particular. As a result, the bolt carrier 2110 moves rearwardly engages the ejection carriage 3300 to draw the ejection carriage 3300 rearwardly.

Figure 5B:
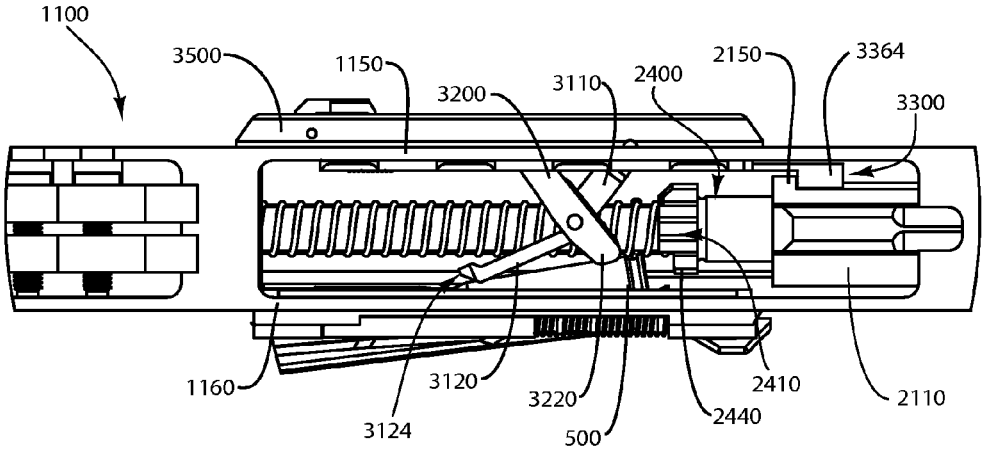

As shown in FIG. 5B, as the ejection carriage 3300 is drawn rearwardly with the bolt carrier 2110, the ejection carriage 3300 may do so in opposition to a biasing force applied by an ejection return spring 3700 (FIG. 3). As previously introduced, the stationary link 3100 (best seen in FIG. 3) and the first end 3112 (also best seen in FIG. 3) of the retaining link 3110 in particular is coupled to the ejection panel 3500 so as not to translate with the ejection carriage 3300. The retaining link 3110 is pivotingly coupled to the translating link 3200, which in turn is coupled to the ejection carriage 3300. As a result, rearward movement of the ejection carriage 3300 with the bolt carrier 2110 causes the translating link 3200 to pivot with respect to the ejection carriage 3300. The pivoting of the translating link 3200 causes the second end 3220 to move away from the ejection carriage 3300. As the second end 3220 of the translating link 3200 moves away from the ejection carriage 3300, the ejection panel 3500, an adjacent sidewall (such as the first sidewall 1150) of the receiver 1100, or other datum or reference point or line as described above, the second end 3118 (best seen in FIG. 3) of the retaining link 3110 may move or sweep across the bolt face 2410 while the second end 3124 of the counter link 3120 moves generally toward the ejection opening 1162 (FIG. 1B), away from the ejection panel 3500, the ejection carriage 3300, and/or the first sidewall 1150 of the receiver 1100 with which those components are associated.

As used herein, movement toward the ejection opening 1162 (best seen in FIG. 1B) may be used interchangeably with movement away from the ejection panel 3500, the ejection carriage 3300, and/or the first sidewall 1150 of the receiver 1100. As the second end 3220 of the translating link 3200 moves or sweeps across the bolt face 2410, the translating link 3200 urges the cartridge 500 (or spent casing) transversely from the bolt face 2410. In at least one example, the spent casing or cartridge 500 may leave the bolt head 2400 from the portion of the bolt head 2400 associated with the clearance lugs 2440. Accordingly, the clearance lugs 2440 may facilitate ejection of the spent casing or cartridge 500 from the engagement with the bolt head 2400.

Figure 5C:
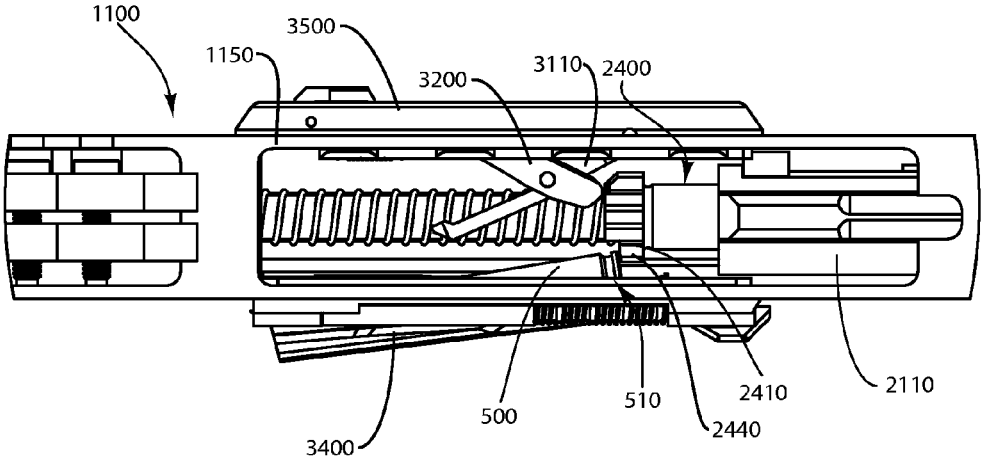

As the spent casing or cartridge 500 is ejected from the bolt head 2400, the counter link 3120 and/or the translating link 3200 may urge the cartridge or casing into position relative to the forward ejection guide cover 3400 (FIG. 5C). More specifically, in at least one example, the ejection carriage 3300 continues sufficiently rearward (and thus the links extend sufficiently from the ejection panel 3500) after the translating link 3200 has moved the spent casing or cartridge 500 from retention by the bolt head 2400 to cause the second end 3220 of the translating link 3200 and the second end 3124 of the counter link 3120 to move the spent casing or cartridge 500 into position relative to the forward ejection guide cover 3400. This position may correspond to a position adjacent the second sidewall 1160 of the receiver 1100. The ejection assembly 300 may also maintain the spent casing or cartridge 500 in position momentarily as the bolt carrier 2110 reaches the rearmost position in its travel.

Referring again to FIG. 3, the ejection return spring 3700 may be secured to the ejection panel 3500 and/or the receiver 1100 (FIG. 1A) via a return spring pin 3730, a corresponding engagement feature in the forward end, or front wall 3330 of the ejection carriage 3300, such as a return spring engagement opening 3334. As a result, a forward end of the ejection return spring 3700 may be relatively stationary. The ejection return spring 3700 may also be coupled to a front end 3330 of the ejection carriage 3300. Accordingly, rearward movement of the ejection carriage 3300 may result in a biasing force that acts on the ejection carriage 3300 that acts to move the ejection carriage 3300 forward.

As shown in FIG. 5C, as the bolt head 2400 translates forward, the bolt head 2400 contacts a rear portion 510 of the spent casing or cartridge 500 in such a manner as to move the cartridge 500 forward without retaining the cartridge 500 on the bolt face 2410. For example, the bolt head 2400 may contact the rear portion 510 of the spent casing or cartridge 500 in such a manner that the outer perimeter portion 2420 and/or the extractor claw 2800 (FIG. 2A) do not contact a rimmed portion of the spent casing or cartridge 500. In at least one example, this contact may occur between the clearance lugs 2440 (which in some examples omit a bolt face lip 2415, as described above) to allow the bolt head 2400 to drive the spent casing or cartridge 500 from the forward ejection guide cover 3400.

In the illustrated example, when the forward ejection guide cover 3400 is closed, the bolt head 2400 drives the spent casing or cartridge 500 forward. In at least one example, the forward ejection guide cover 3400 may be pivotingly coupled to the receiver to thereby cover ejection opening 1162 (FIG. 1B) defined in the receiver 1100. The forward ejection guide cover 3400 may be opened to allow side and/or rearward ejection of the spent casing. In particular, when the forward ejection guide cover 3400 is open relative to the ejection opening 1162 (FIG. 1B) defined in the receiver 1100, the initial contact between the translating link 3200 and the cartridge 500 (or spent casing) as the translating link 3200 sweeps across the bolt face 2410 as the bolt carrier 2110 is drawn rearwardly is sufficient to disengage the cartridge 500 from the bolt head 2400 and eject the spent casing or cartridge 500 via the ejection opening 1162 (FIG. 1B).

The forward ejection guide cover 3400 may be manually removed or opened as desired. In other examples, manually cycling the action 200 (FIG. 1A) may move the forward ejection guide cover 3400 from covering the ejection opening 1162.

Figure 5D:
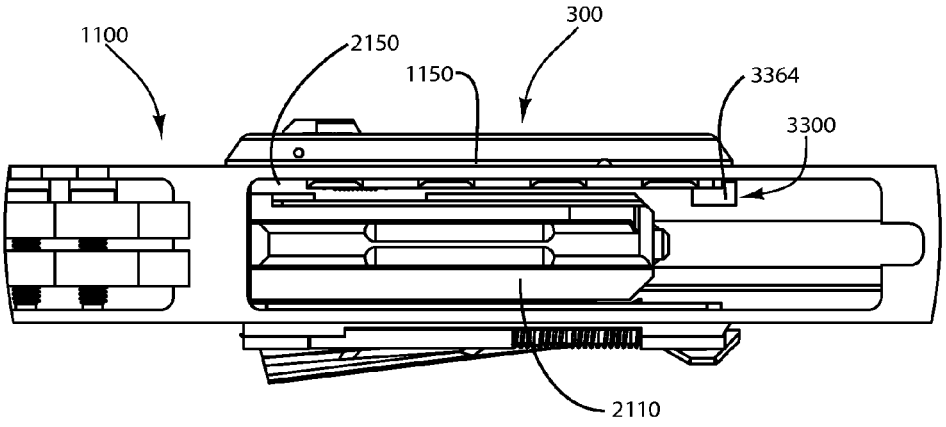

As the bolt carrier 2110 moves toward the rearmost position in its travel, the recoil spring 2360 acts to move the recoil rod 2310 (both seen in FIG. 2A) and thus the bolt carrier 2110 forward. As shown in FIG. 5D, as the bolt carrier 2110 moves forward, the ejection return spring 3700) (FIG. 3) counters the movements described above to move the second end 3220 of the translating link 3200, the second end 3124 of the counter link 3120, and the second end 3118 (all best seen in FIG. 3) of the retaining link 3110 toward the ejection panel 3500 (all best seen in FIG. 3) and the first sidewall 1150 of the receiver 1100 to which the associated links are coupled to thereby retract or collapse the ejection assembly 300.

If another cartridge is in position to be fed from the magazine 1400 (FIG. 1A) into the barrel 1200 (and a chamber defined therein in particular), continued forward movement of the bolt carrier 2110 and the bolt head 2400 strips a cartridge from the magazine 1400 and pushes the cartridge 500 toward the barrel to begin a feed step, as set forth above.

Ejection assemblies, actions including such ejection assemblies, and firearms including such actions and/or ejection assemblies are provided herein. At least one ejection assembly according is provided that is configured to provide forward ejection when a forward ejection guide cover is in place on a receiver and to allow for side ejection when the forward ejection guide cover is out of place on the receiver. Such a configuration may allow for reliable ejection and access to the action for clearance of jams or malfunctions while providing flexibility with forward or conventional side ejection.

What is claimed is:

1. A firearm ejection assembly, comprising:

an ejection panel, an ejection carriage coupled to the ejection panel so as to allow the ejection carriage to translate axially relative to the ejection panel;

a translating link having a first end and a second end, the first end of the translating link being pivotingly coupled to the ejection carriage and configured to translate therewith; and a stationary link having a first end and a second end, wherein the first end of the stationary link is coupled to the ejection panel and the stationary link is coupled to the translating link at a location on the translating link between the first end of the translating link and the second end of the translating link, wherein axial translation of the ejection carriage relative to the ejection panel causes the second end of the translating link and the second end of the stationary link to move transversely with respect to the ejection panel.

2. The ejection assembly of claim 1, wherein the ejection panel is part of a receiver of a firearm.

3. The ejection assembly of claim 1, wherein the first end of the stationary link includes a retaining link and the second end of the stationary link includes a counter link.

4. The ejection assembly of claim 3, wherein the retaining link and the counter link are pivotingly coupled.

5. The ejection assembly of claim 3, further comprising a biasing member coupled to the counter link, the biasing member being configure to exert a biasing force on the counter link to urge the counter link toward linear alignment with the retaining link while allowing the counter link to pivot, wherein the counter link includes a first end and a second end, the first end of the counter link being pivotingly coupled to the retaining link, wherein the biasing force exerted on the counter link allows the second end of the counter link to deflect toward the ejection panel when a force acts against the second end of the counter link.

6. The ejection assembly of claim 1, wherein the ejection carriage includes a bolt carrier engagement portion extending away from the ejection carriage in a direction that is away from the ejection panel.

7. The ejection assembly of claim 1, wherein the first end of the stationary link is coupled to the ejection panel such that the stationary link does not translate with the ejection carriage.

8. The ejection assembly of claim 7, wherein the first end of the stationary link and the first end of the translating link are each at least partially received within the ejection carriage and the ejection carriage is at least partially received within the ejection panel.

9. The ejection assembly of claim 8, wherein transverse movement of the second end of the translating link and the second end of the stationary link is away from the ejection panel.

10. A firearm ejection assembly, comprising:

a receiver having a first sidewall and a second sidewall opposite the first sidewall, a front portion, and a rear portion;

an ejection panel coupled to the first sidewall of the receiver;

an ejection carriage coupled to the ejection panel so as to allow the ejection carriage to translate axially relative to the ejection panel;

a translating link having a first end and a second end, the first end of the translating link being pivotingly coupled to the ejection carriage and configured to translate therewith; and a stationary link having a first end and a second end, wherein the first end of the stationary link is coupled to the ejection panel and the stationary link is coupled to the translating link at a location on the translating link between the first end of the translating link and the second end of the translating link, wherein rearward translation of the ejection carriage relative to the ejection panel causes the second end of the translating link and the second end of the stationary link to move toward the second sidewall of the receiver.

11. The ejection assembly of claim 10, wherein the second sidewall has an ejection opening defined therein.

12. The ejection assembly of claim 11, further comprising a forward ejection guide cover coupled to second sidewall of the receiver adjacent the ejection opening defined in the second sidewall.

13. The ejection assembly of claim 12, wherein the forward ejection guide cover is configured to guide a spent casing from the receiver at an angle of between about 4 and about 12 relative to the second sidewall.

14. The ejection assembly of claim 12, wherein the forward ejection guide cover includes base defining a plane and a multi-stage ejection port having a first ejection angle as measured from the plane and a second ejection angle measured from the plane, the second ejection angle being greater than the first ejection angle.

15. The ejection assembly of claim 14, wherein the first ejection angle is between about 3 and 5 degrees and the second ejection angle is between about 8-12 degrees.

16. A firearm, comprising:

a receiver having a first sidewall and a second sidewall opposite the first sidewall, a front portion, and a rear portion;

a barrel coupled to the receiver, the barrel defining a central axis;

an ejection panel coupled to the first sidewall of the receiver;

an ejection carriage coupled to the ejection panel so as to allow the ejection carriage to translate parallel to the central axis;

a translating link having a first end and a second end, the first end of the translating link being pivotingly coupled to the ejection carriage and configured to translate therewith;

a stationary link having a first end and a second end, wherein the first end of the translating link is coupled to the ejection panel and the second end of the stationary link is coupled to the translating link at a location on the translating link between the first end of the translating link and the second end of the translating link, wherein rearward translation of the ejection carriage relative to the ejection panel causes the second end of the translating link and the second end of the stationary link to move toward the second sidewall of the receiver; and an action operatively associated with the receiver, the action including a bolt carrier, wherein rearward movement of the action engages the ejection carriage to cause the ejection carriage to translate rearward to cause the second end of the translating link and the second end of the stationary link to move toward the second sidewall of the receiver.

17. The firearm of claim 16, wherein the action further includes a bolt head coupled to the bolt carrier, wherein the bolt head includes a bolt face, an outer perimeter portion that extends in an axial direction away from the bolt face, and a cartridge gripping portion that extends transversely away from the outer perimeter portion.

18. The firearm of claim 17, further comprising a plurality of lugs that extend away from the outer perimeter portion in the opposite direction of the cartridge gripping portion and a plurality of clearance lugs formed about the perimeter of the bolt face not associated with a bolt face lip, wherein the clearance lugs extend from the bolt face in the opposite direction of the bolt face.

19. The firearm of claim 18, wherein the clearance lugs are positioned on the side of the bolt head 2440 that is positioned opposite the location of the ejection assembly.

20. The firearm of claim 19, wherein the clearance lugs correspond to between 80 to 100 degrees of the bolt face.

* * * * *